US009589543B2

(12) United States Patent
Lawrence et al.

(10) Patent No.: US 9,589,543 B2
(45) Date of Patent: Mar. 7, 2017

(54) STATIC FRAME IMAGE QUALITY IMPROVEMENT FOR SINK DISPLAYS

(71) Applicant: Intel Corporation, Santa Clara, CA (US)

(72) Inventors: Sean J. Lawrence, Bangalore (IN); Raghavendra Angadimani, Bangalore (IN)

( * ) Notice: Subject to any disclaimer, the term of this patent is extended or adjusted under 35 U.S.C. 154(b) by 37 days.

(21) Appl. No.: 14/661,991

(22) Filed: Mar. 18, 2015

(65) Prior Publication Data

US 2016/0275919 A1 Sep. 22, 2016

(51) Int. Cl.
*G09G 5/39* (2006.01)

(52) U.S. Cl.
CPC ..... *G09G 5/39* (2013.01); *G09G 2360/127* (2013.01); *G09G 2370/16* (2013.01)

(58) Field of Classification Search
CPC ..... H04N 21/234336
See application file for complete search history.

(56) References Cited

U.S. PATENT DOCUMENTS 5,781,196 A * 7/1998 Streater ..... G06T 9/007 345/428
6,108,447 A * 8/2000 Lord ..... G06T 9/007 345/420
6,256,413 B1 * 7/2001 Hirabayashi ..... H04N 19/176 375/E7.139
8,964,830 B2 * 2/2015 Perlman ..... A63F 13/355 345/161

(Continued)

FOREIGN PATENT DOCUMENTS

WO 2012106644 8/2012

OTHER PUBLICATIONS

Bhowmik et al., "System-Level Display Power Reduction Technologies for Portable Computing and Communications Devices", Portable Information Devices, 2007. PORTABLE07. IEEE International Conference, Found at: http://www.ruf.rice.edu/~mobile/elec518/readings/display/intel07.pdf (5 pages).

(Continued)

*Primary Examiner* — Ashish K Thomas

(74) *Attorney, Agent, or Firm* — Green, Howard & Mughal, LLP

(57) ABSTRACT

One or more system, apparatus, method, and computer readable media is described for improving the quality of static image frames having a relatively long residence time in a frame buffer on a sink device. Where a compressed data channel links a source and sink, the source may encode additional frame data to improve the quality of a static frame presented by a sink display. A display source may encode frame data at a nominal quality and transmit a packetized stream of the compressed frame data. In the absence of a timely frame buffer update, the display source encodes additional information to improve the image quality of the representation of the now static frame. A display sink device presents a first representation of the frame at the nominal image quality, and presents a second representation of the frame at the improved image quality upon subsequently receiving the frame quality improvement data.

14 Claims, 11 Drawing Sheets

(56) References Cited

U.S. PATENT DOCUMENTS

2002/0101442 A1* 8/2002 Costanzo ..... H04L 29/06027 715/723
2002/0126130 A1* 9/2002 Yourlo ..... G06F 3/14 345/582
2003/0161398 A1* 8/2003 Feder ..... H04N 21/23433 375/240.03
2007/0242129 A1* 10/2007 Ferren ..... H04N 7/142 348/14.01
2008/0174612 A1* 7/2008 Someya ..... G09G 3/2044 345/690
2008/0214239 A1 9/2008 Hashimoto et al.
2009/0009461 A1* 1/2009 Chia ..... G09G 3/2092 345/99
2010/0085489 A1 4/2010 Hagemeier et al.
2012/0013746 A1 1/2012 Chen
2012/0075334 A1 3/2012 Pourbigharaz et al.
2012/0183039 A1* 7/2012 Rajamani ..... H04N 19/124 375/240.02
2014/0281896 A1 9/2014 Wiitala et al.
2015/0067186 A1 3/2015 Kuhn
2015/0348509 A1* 12/2015 Verbeure ..... H04N 9/3188 345/213

OTHER PUBLICATIONS

Barile, "Intel WiDi Technology: Technical Overview Enabling Dual Screen Apps", Apr. 2-3, 2014, https://intel.lanyonevents.com/sz14/connect/sessionDetail.ww?SESSION_ID=1204 (66 pages).
Wi-Fi Alliance, Wi-Fi Display, Technical Specification, Version 1.0.0, Copyright 2012, Wi-Fi Alliance® Technical Committee, Wi-Fi Display Technical Task Group (151 pages).
Non-Final Office Action mailed Apr. 21, 2016, for U.S. Appl. No. 14/667,525.
International Search Report and Written Opinion for International Patent Application No. PCT/US2016/018319, mailed on Jul. 13, 2016.
Notice of Allowance for U.S. Appl. No. 14/667,525 mailed Aug. 17, 2016, 5 pages.

* cited by examiner

STATIC FRAME IMAGE QUALITY IMPROVEMENT FOR SINK DISPLAYS

BACKGROUND

Image frames may be encoded where a wireless or wired data channel has insufficient bandwidth to timely send the frame data in an uncompressed format. Depending on the available channel bit rate, a given frame maybe compressed to provide a higher or lower quality representation.

With the increase in mobile devices and the prevalence of wireless networking, wireless display capability is experiencing rapid growth. In wireless display technology, a wireless link between a source device and sink display device replaces the typical data cable between computer and monitor. Wireless display protocols are typically peer-to-peer or "direct" and most usage models have a mobile device transmitting media content to be received and displayed by one or more external displays or monitors. In a typical screencasting application for example, a smartphone is wirelessly coupled to one or more external monitors, display panels, televisions, projectors, etc.

Wireless display specifications (e.g., WiDi v3.5 by Intel Corporation, and Wi-Fi Display v1.0 or WFD from the Miracast program of the Wi-Fi Alliance) have been developed for the transmission of compressed graphics/video data and audio data streams over wireless local area networks of sufficient bandwidth. For example, current wireless display technologies utilizing WiFi technology (e.g., 2.4 GHz and 5 GHz radio bands) are capable of streaming encoded full HD video data as well as high fidelity audio data (e.g., 5.1 surround).

In many applications and use cases, frame updates from a source to a sink may arrive in bursts with some frames persisting longer in a display buffer than others as a function of a variable display buffer update frequency. For example, where a GUI active on a source device is screencast to a sink display device, source device power may be saved if a graphics stack executing on the source device renders a new frame of the GUI to the display buffer only as needed to accommodate a scene change (e.g., cursor movement, etc.). A given frame may then persist in the display buffer for multiple screen refresh cycles. Accordingly, the manner in which a source provides such static frames to a sink display device may impact a user's perception and experience with the source and sink devices.

BRIEF DESCRIPTION OF THE DRAWINGS

The material described herein is illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. In the figures.

DETAILED DESCRIPTION OF EXEMPLARY EMBODIMENTS

Figure 1A:
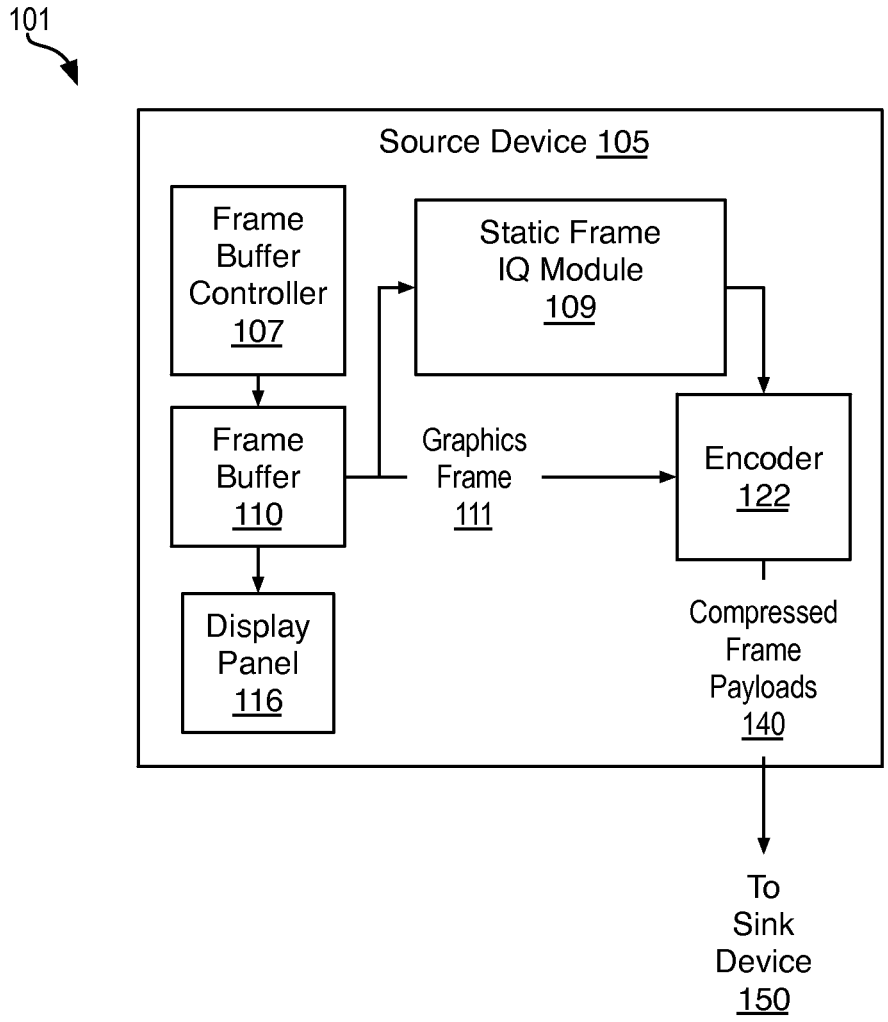
FIG. 1A is a schematic depicting a source device including a static frame quality improvement module, in accordance with some embodiments.

One or more embodiments are described with reference to the enclosed figures. While specific configurations and arrangements are depicted and discussed in detail, it should be understood that this is done for illustrative purposes only. Persons skilled in the relevant art will recognize that other configurations and arrangements are possible without departing from the spirit and scope of the description. It will be apparent to those skilled in the relevant art that techniques and/or arrangements described herein may be employed in a variety of other systems and applications beyond what is described in detail herein.

Reference is made in the following detailed description to the accompanying drawings, which form a part hereof and illustrate exemplary embodiments. Further, it is to be understood that other embodiments may be utilized and structural and/or logical changes may be made without departing from the scope of claimed subject matter. Therefore, the following detailed description is not to be taken in a limiting sense and the scope of claimed subject matter is defined solely by the appended claims and their equivalents.

In the following description, numerous details are set forth, however, it will be apparent to one skilled in the art, that embodiments may be practiced without these specific details. Well-known methods and devices are shown in block diagram form, rather than in detail, to avoid obscuring more significant aspects. References throughout this specification to "an embodiment" or "one embodiment" mean that a particular feature, structure, function, or characteristic described in connection with the embodiment is included in at least one embodiment. Thus, the appearances of the phrase "in an embodiment" or "in one embodiment" in various places throughout this specification are not necessarily referring to the same embodiment. Furthermore, the particular features, structures, functions, or characteristics described in the context of an embodiment may be combined in any suitable manner in one or more embodiments. For example, a first embodiment may be combined with a second embodiment anywhere the particular features, structures, functions, or characteristics associated with the two embodiments are not mutually exclusive.

As used in the description of the exemplary embodiments and in the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items.

As used throughout the description, and in the claims, a list of items joined by the term "at least one of" or "one or more of" can mean any combination of the listed terms. For example, the phrase "at least one of A, B or C" can mean A; B; C; A and B; A and C; B and C; or A, B and C.

The terms "coupled" and "connected," along with their derivatives, may be used herein to describe functional or structural relationships between components. It should be understood that these terms are not intended as synonyms for each other. Rather, in particular embodiments, "connected" may be used to indicate that two or more elements are in direct physical, optical, or electrical contact with each other. "Coupled" may be used to indicated that two or more elements are in either direct or indirect (with other intervening elements between them) physical, optical, or electrical contact with each other, and/or that the two or more elements co-operate or interact with each other (e.g., as in a cause an effect relationship).

Some portions of the detailed descriptions provide herein are presented in terms of algorithms and symbolic representations of operations on data bits within a computer memory. Unless specifically stated otherwise, as apparent from the following discussion, it is appreciated that throughout the description, discussions utilizing terms such as "calculating," "computing," "determining" "estimating" "storing" "collecting" "displaying," "receiving," "consolidating," "generating," "updating," or the like, refer to the action and processes of a computer system, or similar electronic computing device, that manipulates and transforms data represented as physical (electronic) quantities within the computer system's circuitry including registers and memories into other data similarly represented as physical quantities within the computer system memories or registers or other such information storage, transmission or display devices.

While the following description sets forth embodiments that may be manifested in architectures, such system-on-a-chip (SoC) architectures for example, implementation of the techniques and/or arrangements described herein are not restricted to particular architectures and/or computing systems, and may be implemented by any architecture and/or computing system for similar purposes. Various architectures employing, for example, multiple integrated circuit (IC) chips and/or packages, and/or various computing devices and/or consumer electronic (CE) devices such as set-top boxes, smartphones, etc., may implement the techniques and/or arrangements described herein. Further, while the following description may set forth numerous specific details such as logic implementations, types and interrelationships of system components, logic partitioning/integration choices, etc., claimed subject matter may be practiced without such specific details. Furthermore, some material such as, for example, control structures and full software instruction sequences, may not be shown in detail in order not to obscure the material disclosed herein.

Certain portions of the material disclosed herein may be implemented in hardware, for example as logic circuitry in an image processor. Certain other portions may be implemented in hardware, firmware, software, or any combination thereof. At least some of the material disclosed herein may also be implemented as instructions stored on a machine-readable medium, which may be read and executed by one or more processors (graphics processors and/or central processors). A machine-readable medium may include any medium and/or mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical, or other similarly non-transitory, tangible media.

Source devices often have the ability to enter a panel self-refresh (PSR) mode where a source display screen will represent a static frame repeatedly over multiple refresh cycles in the absence of an image frame buffer update. Likewise, when the source is linked to a sink by a channel necessitating data compression, such as, but not limited to wireless links (e.g., WiDi), the source may enter a PSR mode and pause encoded frame transmission to the sink in the absence of further image frame buffer updates. In the event the source ceases frame transmission, the sink may continue to render and/or display the last frame sent to it by the source (e.g., a sink display self-refresh of the last frame). However, because the sink receives encoded frame data, the quality of a representation of any given frame may be of a relatively low image quality that is readily apparent to a user in the event of extended frame persistence.

Exemplary systems, methods, and computer readable media are described below for improving the quality of static image (graphics) frames having a relatively long residence time in a sink display frame buffer. Where a compressed data channel links a source and sink, the source may encode additional frame data to improve the quality of a static frame presented by a sink display. As used herein, a "static" frame on a sink represents a single frame generated and/or stored by a source (e.g., stored in a source frame buffer). Following some embodiments herein, incremental improvements made to a static frame over a duration that the frame is presented by a sink device retains the persistent nature of a static frame from a user's standpoint (e.g., sink display frame has the appearance of being the same scene statically held on source device). However, a transient drop in scene change data transmission between the source and sink is at least partially backfilled with transmission of quality improvements to the sink's static frame. As such, a user may perceive a static scene on a sink display that more closely matches an uncompressed representation presented on a source display.

In some embodiments, a display source encodes a frame at a nominal image quality and transmits a packetized stream including payloads of the compressed frame data. In the absence of a timely frame buffer update, the display source encodes additional information to improve the quality of the representation of the now static frame. A display sink device presents a first representation of a static frame at the nominal image quality, and presents a second representation of the static frame at the improved image quality upon subsequently receiving the frame quality improvement data. By properly supplementing data of the last encoded frame at the source device, a receiving device need only be compliant with standardized codecs, enabling the display device to be independent of static image quality improvement algorithms implemented by the source device.

FIG. 1A is a schematic depicting a source device 105 including a static frame quality improvement module 109, in accordance with some embodiments. Source device 105 further includes a frame buffer controller 107 coupled to a frame buffer 110. Frame buffer 110 may have any known frame buffer architecture, such as, but not limited to, a double (ping-pong) buffer, triple buffer, etc. Frame buffer controller 107 is to output screen change notifications, or "flips" to frame buffer 110. Source device 105 further includes a frame data encoder 122. Encoder 122 is to receive or fetch a digital image or graphics frame from frame buffer 108. Encoder 122 is to output a raw compressed (coded) digital image (graphics) frame data stream representing the input frame. Packetization of the stream generates compressed frame data payloads 140 for transmission to a sink device 150.

Encoder 122 continues in a "normal" operational mode until static frame quality improvement module 109 determines or detects that a frame has persisted in frame buffer 110 for a sufficiently long time so as to qualify as a "static" frame. In some embodiments, the persistence of a frame is quantified by monitoring output screen change notifications. If, for example, a screen change notification has not occurred within a threshold duration, a frame currently stored in the frame buffer 110 is deemed a static frame. Regardless of the static frame detection technique employed, in the event a static frame condition is detected static frame quality improvement module 109 enters an "improved quality" (IQ) operational mode. While in the IQ mode, module 109 outputs a control signal to encoder 122 to cause additional data encoding a representation of the static frame to be generated at the source and/or sent to the sink device as additional compressed frame payloads 140.

Source device 105 is therefore operative in two modes: a normal mode operative while frame buffer updates satisfy a predetermined frequency threshold, and an IQ mode operative when frame buffer updates fail to satisfy the threshold. While in the IQ mode, the quality improvement data output by encoder 122 serves to increase the number of bits encoding a representation of a static frame. In an exemplary embodiment where one or more compressed frame payloads 140 output during normal mode provide an initial frame representation of nominal quality before the frame is determined to be static, one or more additional compressed frame payloads 140 are output during IQ mode to provide a subsequent frame representation of greater quality after the frame is determined to be static.

Figure 1B:
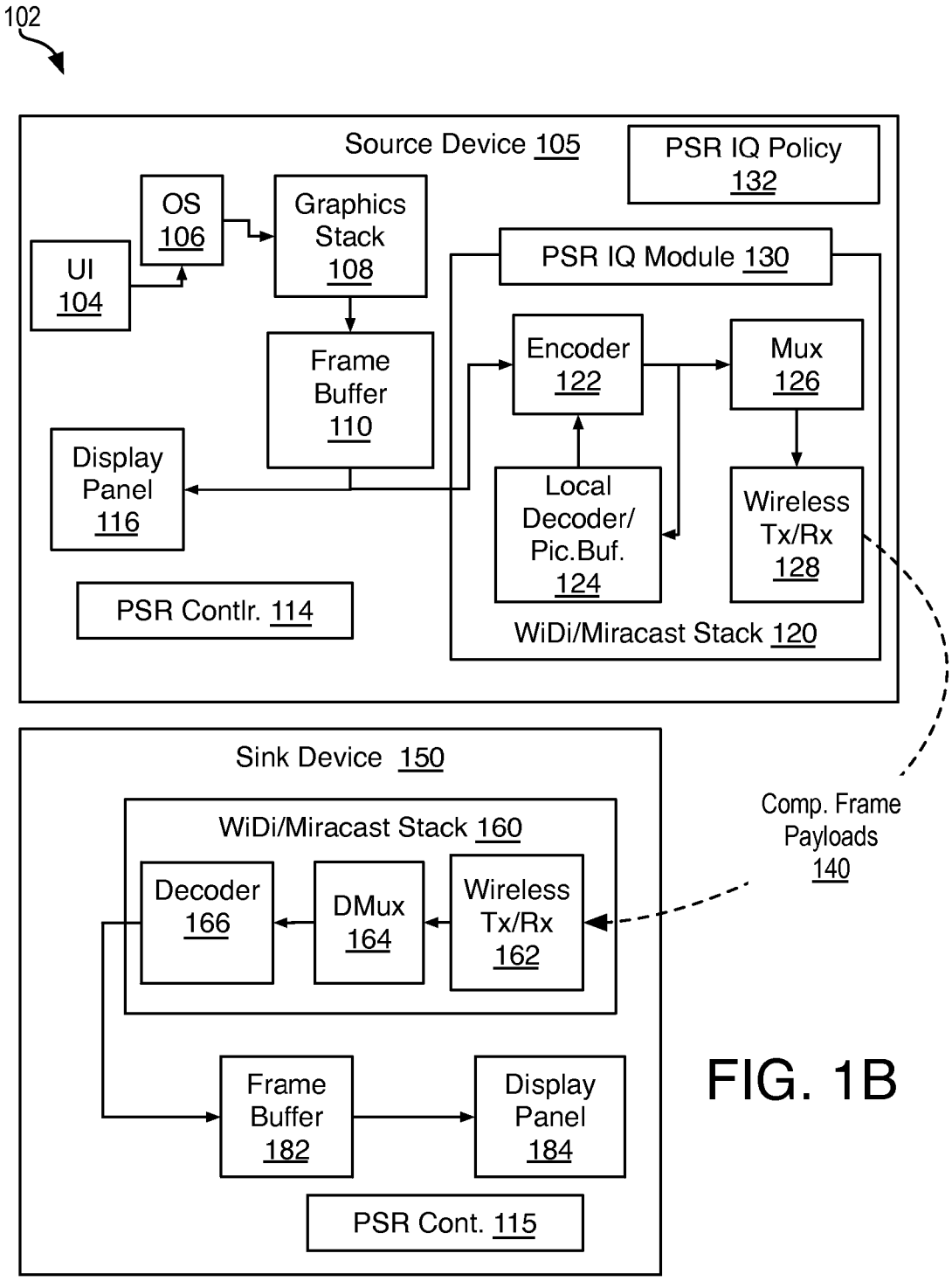
FIG. 1B is schematic depicting a wireless display system including a source device wirelessly linked with a sink display device, in accordance with some embodiments.

FIG. 1B is schematic depicting a wireless display system 102 including one exemplary implementation of source device 105 wirelessly linked with a sink display device 150, in accordance with some embodiments. A similar architecture may be employed for alternative systems that send compressed video frame data between a source and sink display over a wire pipe. In system 102, source device 105 is directly coupled, or "paired," to display (sink) device 150 through a wireless link illustrated in dashed line. Source device 105 may be any device operable to encode and transmit data wirelessly. In the illustrative embodiment, source device 105 executes an operating system (OS) 106 operable to implement a user interface (UI) 104 through which user input may be received. OS 106 is communicatively coupled to graphics stack 108. Graphics stack 108 may including one or more graphics pipeline modules by which graphics objects may be rendered in graphics frames using any technique known in the art. For example, graphics stack 108 may be executed by source device 105 to generate graphics primitives, and/or vertices, perform vertex shading, tessellation, texturing, and/or pixel shading. Graphics stack 108 in some embodiments further includes a frame buffer controller. Graphics stack 108 may output a rendered graphics frame to the frame buffer 110.

In the illustrated embodiment, an output of frame buffer 110 is coupled to an input of display panel 116, which in one embodiment is an embedded display of source device 105. Updates written to frame buffer 110 are output to display panel 116 during a normal operating mode. Source device further includes a panel self-refresh (PSR) control module 114 operable during a source PSR mode to refresh output of display panel 116 with a static frame stored in frame buffer 110 in response to a pause in graphics frame output from graphics stack 108. In either normal or PSR mode, the display panel 116 may be refreshed at some display refresh rate, which may vary between 30 Hz and 1 kHz, for example.

An output of frame buffer 110 is further coupled to encoder 122. In the illustrative embodiment, encoder 122 is part of a transmission protocol stack 120 operable to implement and/or comply with one or more wireless High Definition Media Interface (HDMI) protocol, such as, but not limited to, Wireless Home Digital Interface (WHDI), Wireless Display (WiDi), Wi-Fi Direct, Miracast, WirelessHD, or Wireless Gigabit Alliance (WiGig) certification programs.

Encoder 122 is to output a compressed graphics frame data stream, as a representation of frames generated by graphics stack 108. Encoder 122 may implement any codec known performing one or more of transformation, quantization, motion compensated prediction, loop filtering, etc. In some embodiments, encoder 122 complies with one or more specification maintained by the Motion Picture Experts Group (MPEG), such as, but not limited to MPEG-1 (1993), MPEG-2 (1995), MPEG-4 (1998), and associated International Organization for Standardization/International Electrotechnical Commission (ISO/IEC) specifications. In some exemplary embodiments, encoder 122 complies with one or more of H.264/MPEG-4 AVC standard, HEVC standard, VP8 standard, VP9 standard specifications.

An output of encoder 122 is coupled to a local decode loop including a decoder and picture buffer 124 that is to reconstruct and store reference frame representations. Output of encoder 122 is further coupled to an input of a multiplexer 126 to process one or more coded elementary stream generated by encoder 122 into a higher-level packetized stream. In some embodiments, multiplexer 126 codes the packetized elementary streams into an MPEG program stream (MPS), or more advantageously, into an MPEG transport stream (MTS). In further embodiments, the MTS is encapsulated following one or more of Real-Time Protocol (RTP), user datagram Protocol (UDP) and Internet Protocol (IP) as embodiments are not limited in this context. In some RTP embodiments for example, a Network Abstraction Layer (NAL) encoder (not depicted) receives the MTS and generates Network Abstraction Layer Units (NAL units) that are suitable for wireless transmission.

An output of multiplexer 126 is coupled to a wireless transmitter (Tx) or transceiver (Tx/Rx) 128 coupled to receive the coded stream data and output a wireless signal representative of the coded stream data to a sink device. Wireless transceiver 128 may utilize any band known to be suitable for the purpose of directly conveying (e.g., peer-to-peer) the data stream for real time presentation on a sink device. In some exemplary embodiments, wireless transceiver 105 is operable in the 2.4 GHz and/or 5 GHz band (e.g., Wi-Fi 802.11n). In some other exemplary embodiments, wireless transceiver is operable in the 60 GHz band.

For a time period during which source device 105 is in normal mode, transmission protocol stack 120 is to also operate in normal mode. During normal mode, graphics frame data output to display buffer 110 and flipped to transmission protocol stack 120 is to be encoded, packetized, and transmitted. Source device 105 further includes a PSR improved quality (IQ) module 130, which may be implemented as part of transmission protocol stack 120, or as a discrete controller. In some embodiments, PSR-IQ module 130 is to implement parameters and/or algorithms defined in PSR-IQ policy 132 for at least a portion of the time source device 105 is in "PSR" mode. While PSR-IQ policy 132 is in effect, transmission protocol stack 120 operates in what is referred to herein as "PSR-IQ" mode. While in PSR-IQ mode, transmission protocol stack 120 is to improve the quality of the last frame to have been transmitted in normal mode by encoding, packetizing, and outputting additional graphics frame data, referred to herein as "static frame IQ data." For any time period while source device 105 is in PSR mode, but PSR-IQ policy 132 is not in effect, transmission protocol stack 120 is operative in what is referred to herein simply as "PSR" mode. During PSR mode, no graphics frame data is encoded, packetized, or transmitted by transmission protocol stack 120.

In some embodiments, PSR-IQ policy 132 is implemented by PSR-IQ module 130 in response to source device 105 entering PSR mode. In embodiments, PSR-IQ policy 132 may be implemented until source device 105 exits PSR mode, returning to normal mode (i.e., graphics stack 108 outputs new frames to frame buffer 110 for presentation). In further embodiments, PSR-IQ policy 132 may be implemented until either source device 105 exits PSR mode, or until an improvement in quality of the last normally transmitted frame is deemed complete and transmission protocol stack 120 accordingly enters PSR mode.

As further illustrated in FIG. 1B, sink display device 150 is communicatively coupled to source device 105 through wireless transceiver 162 during a wireless streaming session. Wireless transceiver 162 may utilize any frequency band and wireless communication protocol compatible with that of transceiver 128. An output from wireless transceiver 162 is coupled to an input of de-multiplexer 164, which is to process the encapsulated packetized streams into compressed data inputs passed to decoder 166. De-multiplexer 164 includes logic to unencapsulate and extract audio and video payloads from the packetized A/V stream. Decoder 166 may utilize any codec compatible with that of encoder 122 to generate representations of frame data that are passed to a sink display pipeline. In the illustrated embodiment, the sink display pipeline includes frame buffer 182 and display panel 184, which may be an embedded display of sink device 150.

During a normal operative mode, frame buffer 182 is updated with screen change notifications output by reception protocol stack 160. In some embodiments, sink device 150 further includes a PSR control module 115 operable during a sink PSR mode. PSR control module 115 is to refresh output of display panel 184 with a static frame stored in frame buffer 182 in event of a pause in graphics frame output from reception protocol stack 160. In either normal or PSR mode, display panel 184 may be refreshed at some display refresh rate, which may vary between 30 Hz and 120 Hz, for example.

Figure 2A:
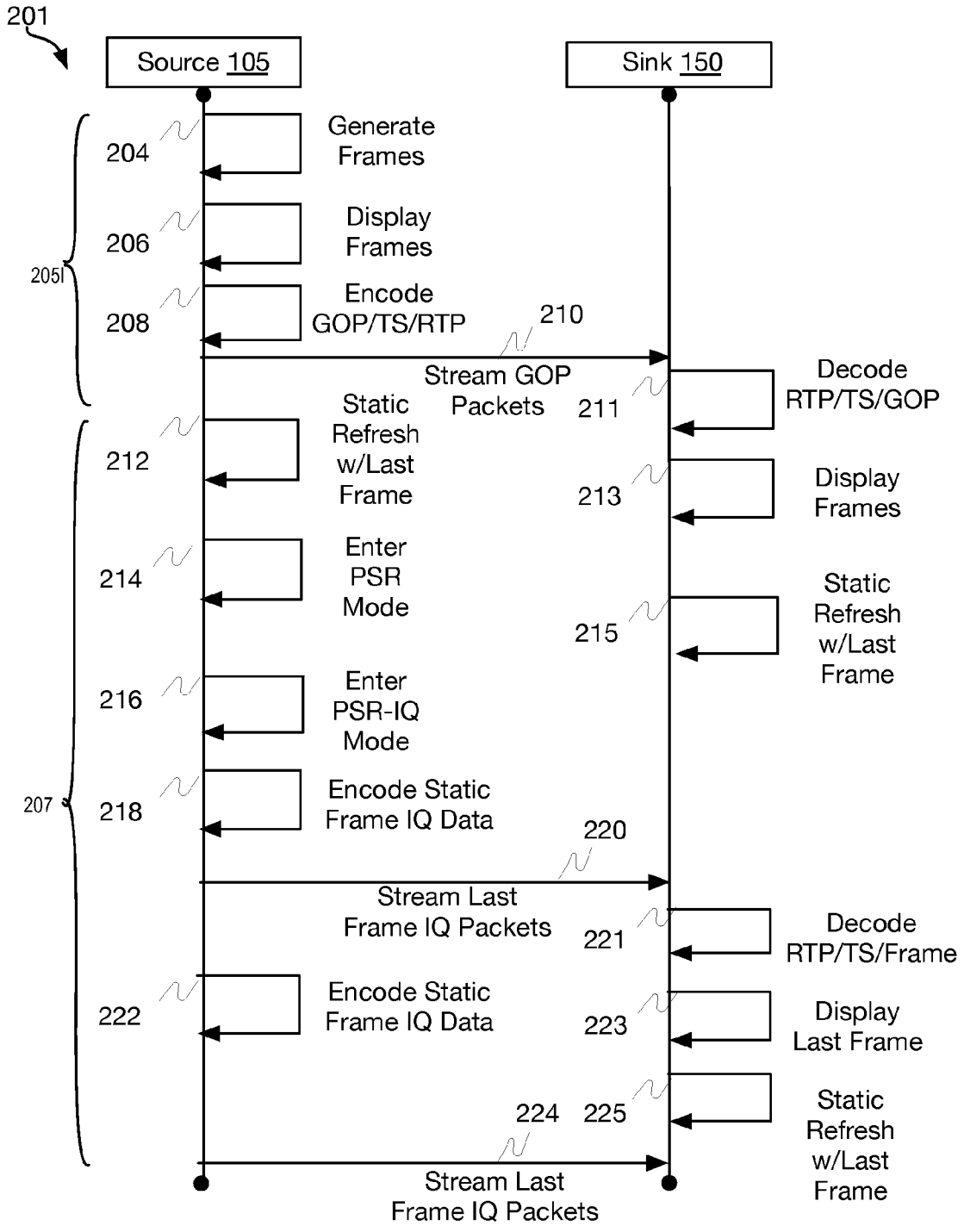
FIG. 2A is a flow diagram depicting a method for static frame quality improvement, in accordance with some embodiments.
Figure 4A:
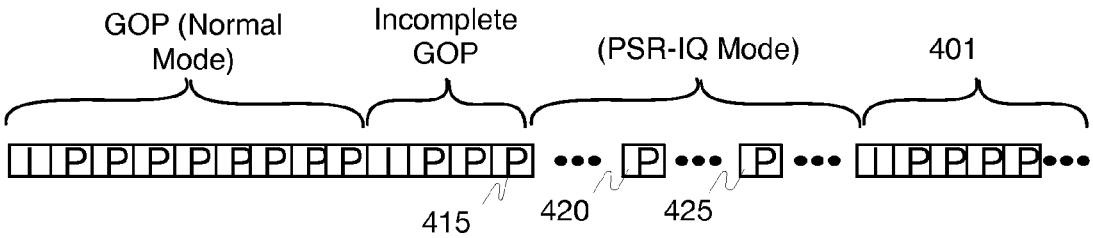
FIGS. 4A and 4B are schematics illustrating a series of image frames transmitted from a source device, or received by a sink device, during PSR-IQ and normal modes, in accordance with some embodiments

FIG. 2A is a flow diagram depicting a method 201 for wireless display static frame quality improvement, in accordance with some embodiments. In the illustrative embodiment, method 201 is performed by wireless display system 102 (FIG. 1B). In other embodiments however, method 201 is implemented by a source device and/or sink device having alternative architectures. Method 201 begins with source 105 generating graphics frames at operation 204, for example in response to user activity inducing a scene change calculation. At operation 206, the source display panel displays frames generated at operation 204. One or more of these same frames are flipped to the transmission protocol stack for encoding at operation 208. In some embodiments, a plurality of frames is encoded as a group of pictures (GOP) using any known technique. Also at operation 208 (FIG. 2A), compressed frames are further encoded into a transport stream and/or a real time stream, again following known techniques. Packets representing the GOP are streamed at operation 210 over a link (e.g., wireless) to sink 150. Operations 204, 206, 208, 210 are all performed while source 105 is in normal mode 205. At operation 211, sink 150 decodes received packet payloads and reconstructed frames corresponding to the GOP are displayed at operation 213. FIG. 4A is a schematic illustrating a series of image frames transmitted from a source device, and/or received by a sink device, during PSR-IQ and normal modes, in accordance with some embodiments. The exemplary GOP in FIG. 4A includes an intra encoded frame (I-frame) followed by eight inter predicted frames (P-frames).

Returning to FIG. 2A, method 201 continues with the source display performing a static refresh at operation 212 and source 105 entering PSR mode 207. In one example, the source OS detects screen inactivity and stops sending screen change notifications to a graphics driver. The graphics driver, in turn, stops sending screen change notifications to the display buffer transmission protocol stack. During static refresh operation 212, the last frame generated at operation 204 continues to reside in a display buffer. In some embodiments, PSR mode 207 is based on a pause in the screen change notifications exceeding a predetermined threshold duration. In response, the transmission protocol stack enters PSR mode at operation 214, and no further frame data is encoded, packetized, and/or transmitted off source device 105. Absent the transmission of additional frames, sink device 150 performs static refresh operation 215 where the last frame displayed at operation 213 is retained in the sink display buffer and utilized to periodically refresh the sink display panel at some nominal rate until the scene at the source changes and the source switches out of PSR mode 207 and back to normal mode 205.

Figure 2B:
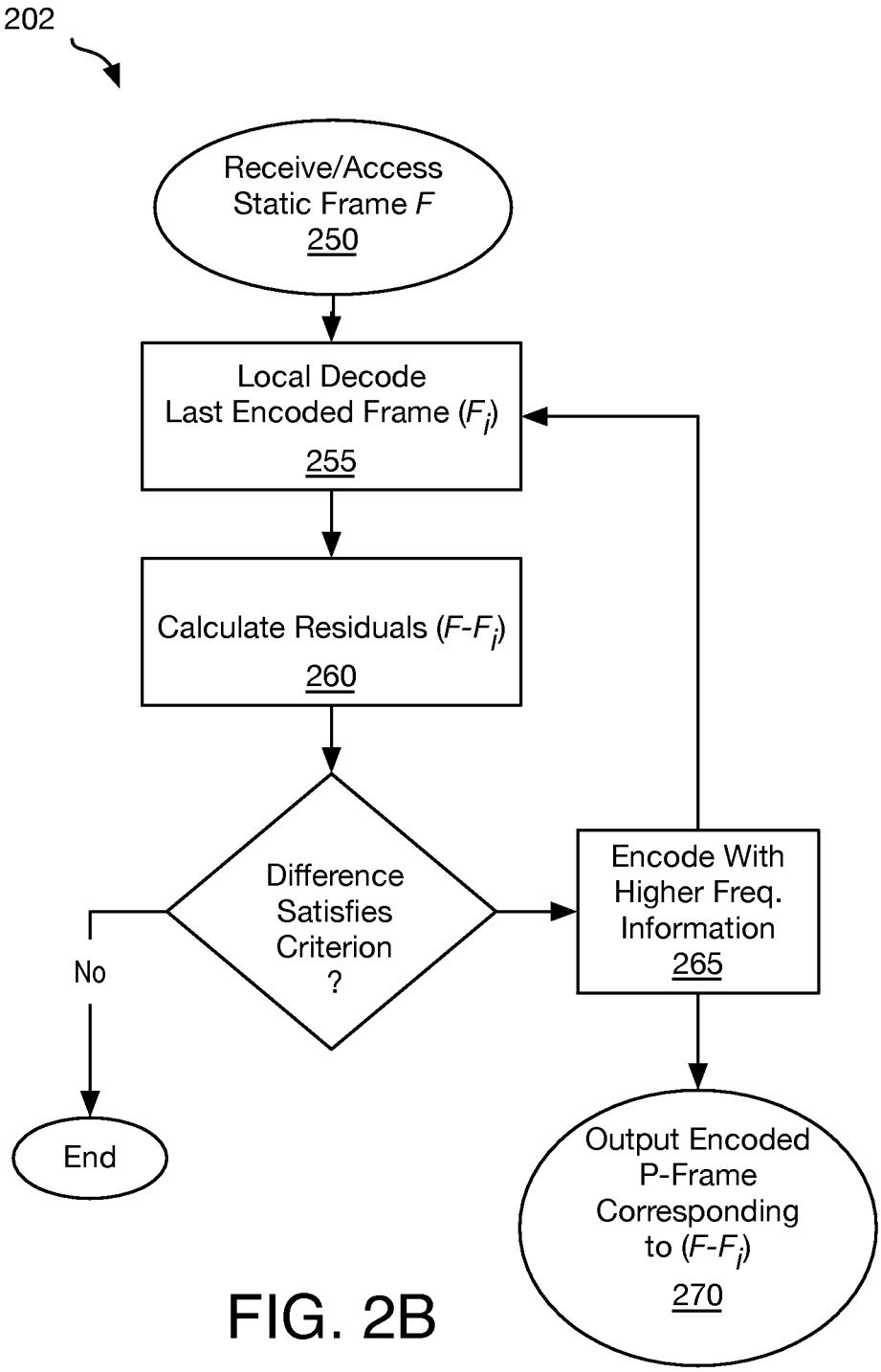
FIG. 2B is a flow diagram depicting a method for iteratively improving static frame quality by encoding one or more additional P-frames, in accordance with some embodiments.

Method 201 continues with the transmission protocol stack entering PSR-IQ mode at operation 216. In some embodiments, PSR-IQ mode is entered in response to source device 105 remaining in PSR mode 207 for some predetermined period of time (e.g., source frame buffer has not been updated for 50-100 msec). Once in PSR-IQ mode, static frame IQ data is encoded at operation 218. Static frame IQ data may include any additional data associated with the last composed frame sent to the sink, that can be decoded by sink 150, and that can improve the image quality of the last frame. In some embodiments, the static frame IQ data includes one or more P-frame further encoding the same scene as that encoded by the last composed frame. FIG. 2B is a flow diagram depicting a method 202 for iteratively improving static frame quality by encoding one or more additional P-frames, in accordance with some embodiments. Method 202 begins at operation 250 where the static frame F (e.g., output by a graphics pipeline) is accessed or received from a local frame buffer. A last encoded frame is passed through a local decode loop at operation 255 to generate a last frame representation $F_i$. The non-encoded frame F is then compared to the frame representation $F_i$ and residuals determined at operation 260 using any known technique. A predetermined criterion may then be applied to determine if an additional P-frame encoding is to be performed at operation 265, or if instead method 202 is to end. If there is a sufficient difference, in quality for example, at operation 265 the static frame F and/or residual $F-F_i$ is encoded in a manner that includes higher frequency components. This subsequent encoded frame $F_{i+1}$ is then output to the transmission stack at operation 270. Method 202 may iterate until the end criterion is satisfied.

In the exemplary embodiment further illustrated in FIG. 4A, the last frame 415 is a P-frame and the static frame IQ data includes another P-frame 420. Notably, P-frame 420 is of the same image frame last output during normal mode. In other words P-frame 420 is associated with the static graphics frame stored in the source display buffer that is represented by last frame 415. In some embodiments, P-frame 420 includes high frequency components absent from last frame 415. For example, P-frame 415 may include coarse image data of lower frequency components while P-frame 420 includes fine image data of higher frequency. High frequency components may be determined by any known technique. In one example, the high frequency data included in P-frame 420 is associated with transform coefficients that where dropped during the encoding of last frame 415. In some embodiments, the data encoded in P-frame 420 is in the form of residuals encoded based on a comparison of a reconstruction of last frame 415 (e.g., locally decoded and stored in the picture buffer 124 in FIG. 1B) and the static frame stored in the source display buffer (e.g., frame buffer 110 in FIG. 1B).

Returning to FIG. 2A, method 201 continues at operation 220 where the static frame IQ packets are streamed to sink 150. The streamed packets are decoded at operation 221 and an updated last frame of improved quality is output to the sink display buffer and displayed at operation 223. This updated last frame of improved quality then resides in the sink display buffer and is statically refreshed at operation 225.

In some embodiments, static frame IQ data is sent multiple times with each additional set of static frame IQ data incrementally improving the quality of the static frame representation at the sink device. In method 201 for example, at operation 222 additional static frame IQ data is encoded. In some embodiments, each iteration of static frame IQ data transmission comprises sending one additional P-frame of the last composed frame to further improve the quality of the sink static image. In the exemplary embodiment further illustrated in FIG. 4A therefore, the static frame IQ data further includes P-frame 425. Notably, P-frame 425 is again a representation of the image frame last output during normal mode. In other words P-frame 425 is also associated with the static image frame stored in the source display buffer that is represented by last frame 415. In some embodiments, P-frame 425 includes high frequency components absent from last frame 415 and P-frame 420. This high frequency data may be associated, for example, with transform coefficients that where dropped during the encoding of static frame 415, and also absent in the encoding of P-frame 420. In some embodiments, the data encoded in P-frame 425 is in the form of residuals encoded based on a comparison of a reconstruction of last frame 415 and the static frame stored in the display buffer.

In some embodiments, upon entering PSR-IQ mode, a burst of last frame IQ packets are sent to improve the quality of the static image as rapidly as possible for a given bandwidth or power constraint. In FIG. 4A for example, P-frames 420 and 425 may be sent in a burst. In some other embodiments, upon entering PSR-IQ mode, last frame IQ packets are sent periodically while PSR-IQ mode is active (e.g., P-frames 420 and 425 may be sent consecutively with a predetermined delay between). Periodic quality improvements to a static frame may be temporally spaced to improve the static frame quality in a manner transparent to a user, and/or meter bandwidth and/or power required to transmit the quality improvements, and/or simplify implementation of static frame quality improvement logic. In some embodiments, static frame IQ data is sent in a burst or periodically until a desired quality on the sink display is achieved, or until the source exits PSR mode, whichever condition is met first.

In some embodiments, static frame IQ packets independently re-encoded the last frame transmitted during normal mode. The re-encode operation performed during PSR-IQ mode is performed with different encoder parameters than those employed during normal mode operation. Any encoder parameter that is known to impact frame representation quality may be modified so as to improve the quality of the static frame representation sent to the sink as the static frame IQ packets. In further reference to FIG. 2A, at operation 208 the GOP may be encoded at a first bit rate, and at operation 218, at least the static frame is re-encoded at a second bit rate (e.g., higher). In one such embodiment, a first quantization parameter (QP) value is employed at operation 208, and at operation 218 at least the static frame is re-encoded with a second QP value (e.g., lower than that employed at operation 208) to retain greater spatial detail and high frequency components. Other encoder parameters, such as, but not limited to, quantization tables, motion partitioning parameters, deblocking parameters, and transform parameters may be varied between normal mode frame encoding and a PSR-IQ mode re-encoding of a static frame.

In some embodiments, a transmission/reception protocol stack is configured to perform scalable video coding (SVC). For example, the encoder of a source device may be compliant with Annex G of the H.264/MPEG-4 compression standard. In some SVC embodiments, a high-quality frame bitstream is encoded and only one or more subset bitstreams of that high quality stream are transmitted by a source device during a normal operation mode as a function of the bit rate available between the source and sink during normal operation. For example, in further reference to FIG. 2A, at operation 208 a GOP is encoded into a multi-layer SVC-compliant stream. At operation 210, at least a base layer of the bitstream providing a nominal level of quality is transmitted to sink device 150. Depending on the nominal quality level, one or more enhancement layers may also be transmitted at operation 210. The one or more layer is then decoded and displayed at operations 211, 213. In some embodiments, the multi-layer SVC-compliant stream generated at operation 208 is stored, for example in a circular buffer, at source device. Upon entering PSR mode at operation 212 (or PSR-IQ mode at operation 216), the buffered SVC encoded stream is processed and one or more additional enhancement layer bitstream is transmitted as the static frame IQ packets at operation 220. In some such embodiments, both base layer and one or more additional enhancement layer encoding at least the static frame from the GOP last sent is transmitted at operation 220. Thus, in some embodiments the static frame IQ packets sent at operation 220 carry a more enhanced version (having a greater number of hierarchical layers) of a multi-layer SVC compliant stream than was sent at operation 210. Hence, with a pause in new frame updates at the source resulting in a drop in bandwidth requirements between source 105 and sink 150, a tail end of the last transmitted SVC bit stream may be re-transmitted at a higher quality level to improve the static frame representation at the sink.

Figure 3A:
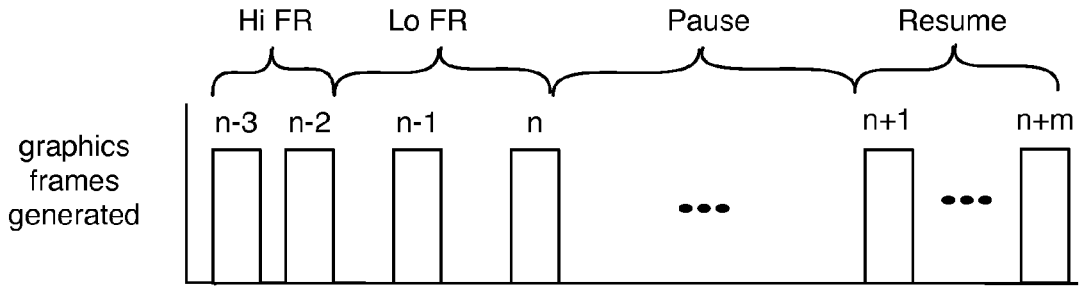
FIGS. 3A, 3B, 3C, and 3D are graphs illustrating frame generation, source presentation, compression, and sink presentation, in accordance with some embodiments.

FIGS. 3A, 3B, 3C, and 3D are graphs further illustrating timing of frame generation, source presentation, compression, and sink presentation, in accordance with some embodiments. The frames illustrated in FIG. 3A-3D may result from practicing method 201 (FIG. 2A). Referring first to FIG. 3A, first frames n−3 and n−2 are generated by a source device graphics pipeline at a high frame rate ("Hi FR"). Next frames n−1 and n are generated by a source device at a low frame rate. Frame generation is paused between frames n and n+1. During this time, the graphics pipeline may be idled and/or in a standby mode. Following the pause, image frames n+1 and n+m are generated.

Figure 3B:
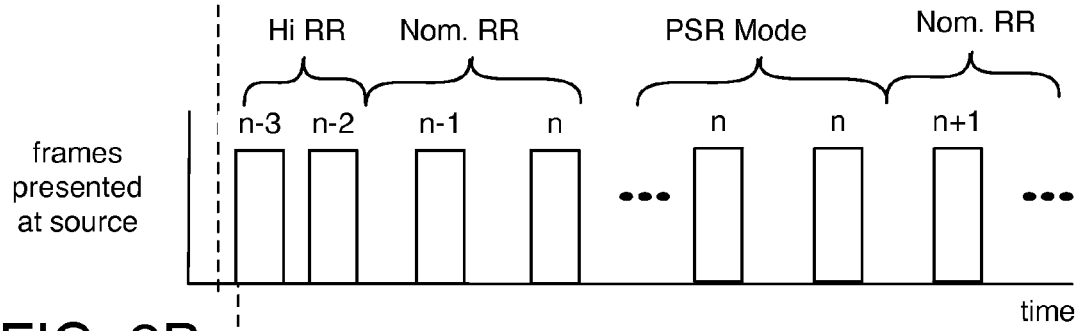

Referring next to FIG. 3B, after a latency period denoted by the dashed line, a source display presents the first image frames n−3 and n−2. In the exemplary embodiment, the source display refresh rate tracks with the frame generation rate such that frames n−3 and n−2 are associated with a high refresh rate ("Hi RR"). Next, frames n=1 and n are output by source display at a lower, nominal refresh rate. Frame n is then refreshed repeatedly while the source is in PSR mode in response to the pause in frame generation. Upon resumption of frame buffer updates, PSR mode is exited and a last frame n+1 is output.

Figure 3C:
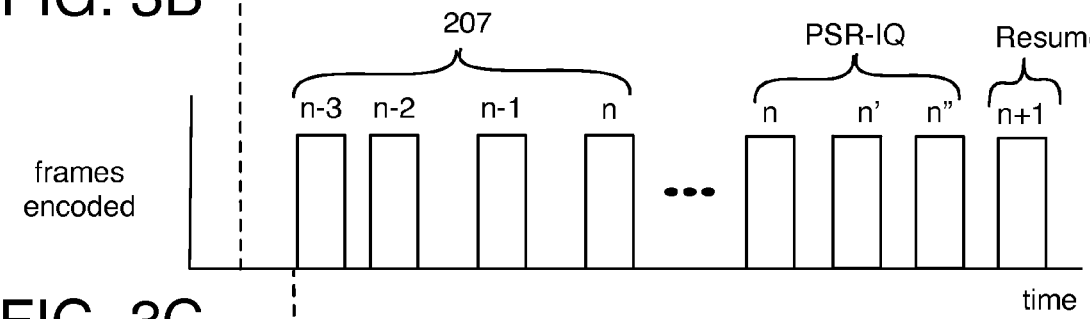

FIG. 3C further illustrates compression of first frames n−3 and n−2 controlled to a first bit rate during normal mode 207 (FIG. 2A). Since the frame generation is at a relatively high frame rate, the bit rate for one or more of frames n−3 and n−2 may be relatively low to maintain a target average bit rate. Next frames n−1 and n may have a higher bit rate in response to a relatively low frame rate. During PSR-IQ mode, frame n IQ data is encoded at least once before exiting PSR-IQ mode to resume encoding last frame n+1 in normal mode. Two encodings of frame n (n' and n") are illustrated in FIG. 3C.

Figure 3D:
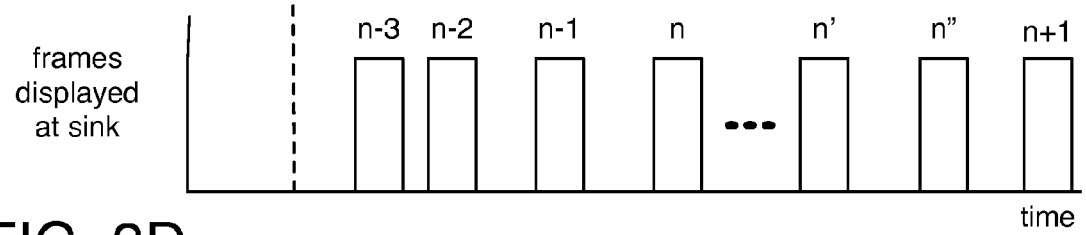

FIG. 3D further illustrates frames presented by a sink display panel. As shown, the display panel is capable of a variable refresh rate, set for example to match display buffer updates and avoid frame tearing and/or stutter. Frames n−3 and n−2 are displayed at a first high refresh rate followed by frames n−1 and n at a lower refresh rate. After some period of time, before or after a static frame n is self-refreshed by the sink display, frame n PSR-IQ data arrives at the sink. The frame n PSR-IQ data is decoded, and the sink display buffer updated with frame n' of the same scene (image) as frame n, but of a higher quality representation. Subsequently, if any additional frame n PSR-IQ data arrives at the sink, is again decoded, and written out to the sink display buffer (e.g., as frame n") providing an even higher quality representation of the same scene. Some time later, frame n+1 is decoded at the sink following the source frame generation recovery. In some embodiments where the static frame duration is considerable (e.g., during a presentation in an Enterprise context), a user can readily perceive the high quality static image n' (n").

Figure 4B:
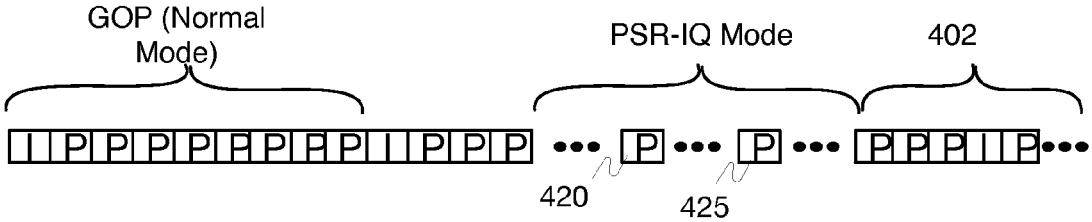

In both FIGS. 4A and 4B, a GOP transmission mechanism is shown. During PSR-IQ mode, frames 420, 425 are transmitted to improve the quality of static image displayed on the sink. In normal mode, the exemplary GOP comprises an I-frame followed by eight P-frames. Static frame PSR-IQ data is sent in the form of P-frames continuing the last incomplete GOP sent before normal mode ended. Hence, at the sink decoder, the static frame PSR-IQ data may be readily decoded following the same GOP structure employed during normal mode. FIG. 4A illustrates some embodiments, where upon resuming normal mode operation, an I-frame is sent as the first frame in a recovery GOP 401. Updating the sink with an I-frame regardless of the position of the last frame within the last GOP ensures any scene change that might have triggered a return to normal mode on the source will be adequately represented on the sink display. Depending on duration of the PSR-IQ mode, recovering with another I-frame may or may not impose an increased bit rate requirement on the network link between the source and sink. If so, the source encoder rate controller may limit the image quality of the I-frame and/or other frames in the recovery GOP 401 as necessary following known techniques. FIG. 4B illustrates alternative embodiments, where upon resuming normal mode operation, a P-frame is sent as the first frame in a recovery GOP 402. Updating the sink with another P frame to complete the last GOP ensures there will not be any quality/bit rate limitations imposed by sending the static frame PSR-IQ data. However, there may be limitations in the sink presentation of scene change scenarios when practicing this recovery mode.

Figure 5:
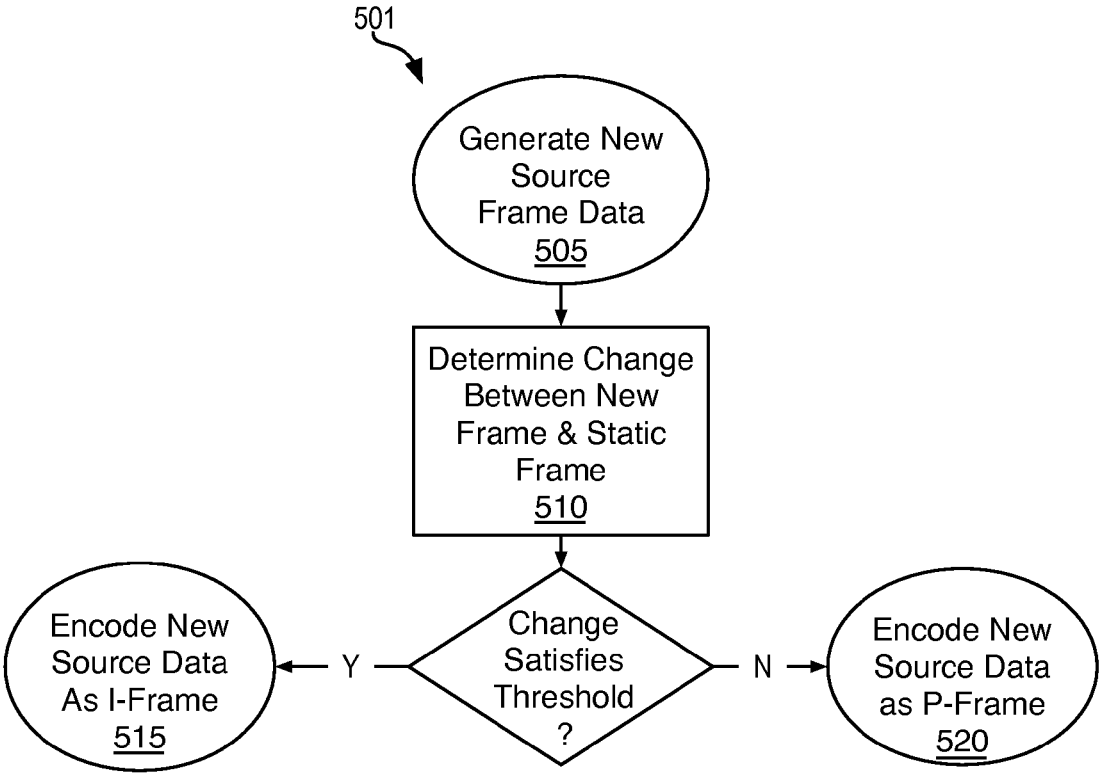
FIG. 5 is a schematic illustrating a method for returning to a normal source/sink mode from a PSR-IQ mode, in accordance with some embodiments.

In some embodiments, selection of an "I-frame first" or "P-frame first" recovery from PSR-IQ mode is dependent upon the amount of scene change between the static image and the new graphics (image) frame that is to be sent to the sink when the source returns to normal mode. FIG. 5 is a schematic illustrating a method 501 for returning to a normal source mode from a PSR-IQ mode, in accordance with some embodiments. In one example, method 501 is implemented by a source device, and more specifically by a transmission protocol stack. In further embodiments, PSR-IQ module 310 (FIG. 1B) is to perform method 501.

Method 501 begins with generating new source frame data at operation 505. In one embodiment for example, a graphics pipeline awakens from a standby or idle period and begins outputting frames to a source frame buffer at a nominal frame rate. In response, PSR-IQ mode ends. At operation 510, an amount of change between a first new frame to be transmitted to the sink and the static frame is determined. Any known scene change quantification may be applied at operation 510 as embodiments are not limited in this respect. The amount of change is compared to a predetermined threshold. In response to the change satisfying the threshold, the new data is encoded as at least an I-frame at operation 515. Any known scene-change frame encoding algorithm may also be utilized at operation 515, for example to select a sufficiently low QP. In response to the change not satisfying threshold, the new frame data is encoded as a P-frame at operation 520.

Figure 6:
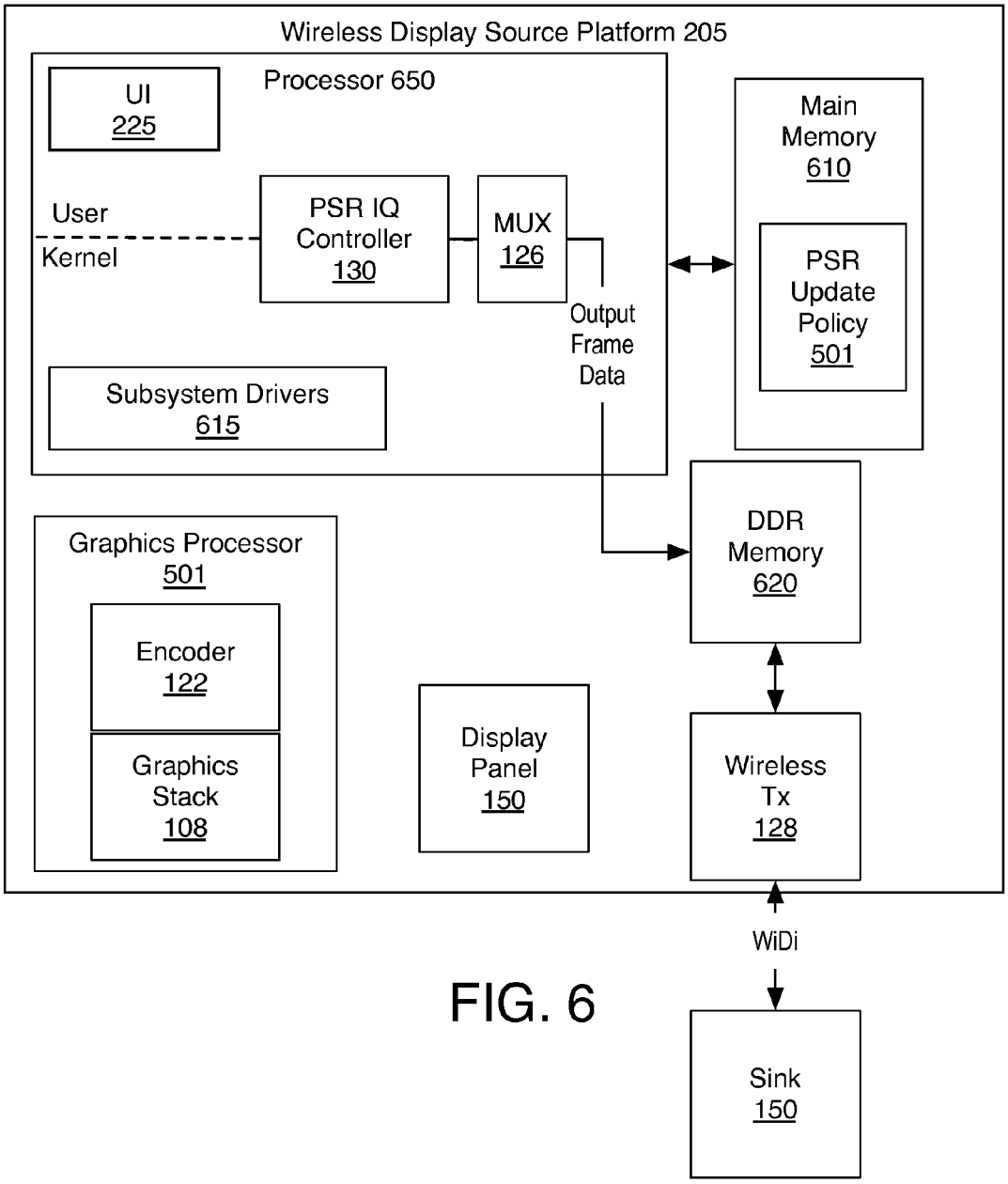
FIG. 6 is a functional block diagram of a source device operable in a PSR-IQ mode, in accordance with embodiments.

FIG. 6 is a functional block diagram further illustrating wireless display source platform 205, in accordance with embodiments. Source platform 205 includes a graphics processor 501. In the exemplary embodiment, graphics processor 501 implements graphics (video) frame encoder 122 and graphics stack 108. Platform 205 further includes a processor 650, which may include one or more logic processor cores. In some advantageous SOC embodiments, processor 605 and graphics processor 501 are integrated onto a single chip. In some heterogeneous embodiments, processor 605 interfaces with graphics processors 501 through subsystem drivers 615. Platform 205 further includes a display panel 150, for example employing any LCD or LED technology.

In the exemplary embodiment, processor 650 implements PSR-IQ module 130, for example as a module of a transmission protocol stack (not depicted). Processor 650 further implements multiplexer 126 (e.g., also as part of a transmission protocol stack). Frames output by graphics stack 108 may be processed into a compressed form by encoder 122 in response to commands issued by PSR-IQ module 130. The encoding and sending of PSR-IQ data in conjunction with display panel 150 entering a panel self-refresh mode may be implemented through either software or hardware, or with a combination of both software and hardware. For pure hardware implementations, PSR-IQ module 130 may be implemented by fixed function logic. For software implementations, any known programmable processor, such as a core of processor 650, may be utilized to implement the logic PSR-IQ module 130. Depending on the embodiment, PSR-IQ module 130 and multiplexer 126 are implemented in software instantiated in a user or kernel space of processor 650. Alternatively, a digital signal processor/vector processor having fixed or semi-programmable logic circuitry may implement one or more of the PSR-IQ module 130 and multiplexer 126, as well as implement any other modules of the transmission protocol stack.

In some embodiments, processor 650 includes one or more (programmable) logic circuits to perform one or more stages of a method for improving the quality of a static frame streamed over a real time wireless protocol, such as, but not limited to WFD or WiDi. For example, processor 650 may perform method 201 (FIG. 2A) in accordance with some embodiments described above. In some embodiments, processor 650 is to access PSR update policy 501 stored in main memory 610, and is to determine PSR-IQ data based on differences in the representation of a static frame last sent to the sink and the static frame presented by the source. In some embodiments, processor 650 executes one or more encoded frame packetization algorithm a kernel space of the instantiated software stack. In some embodiments, processor 650 employs a graphics processor driver included in subsystem drivers 615 to trigger image frame generation, and/or frame encoding. In some embodiments, processor 650 is programmed with instructions stored on a computer readable media to cause the processor to perform one or more static frame quality improvement method, for example such as any of those described elsewhere herein.

As further illustrated in FIG. 6, PSR-IQ data frames may be output by wireless transceiver 128. In one exemplary embodiment, output PSR-IQ data frames are written to electronic memory 620 (e.g., DDR, etc.). Memory 620 may be separate or a part of a main memory 610. Wireless transceiver 128 may be substantially as described elsewhere herein, to convey (e.g., following a real time streaming protocol) the output PSR-IQ data frames to a receiving sink 150.

Figure 7:
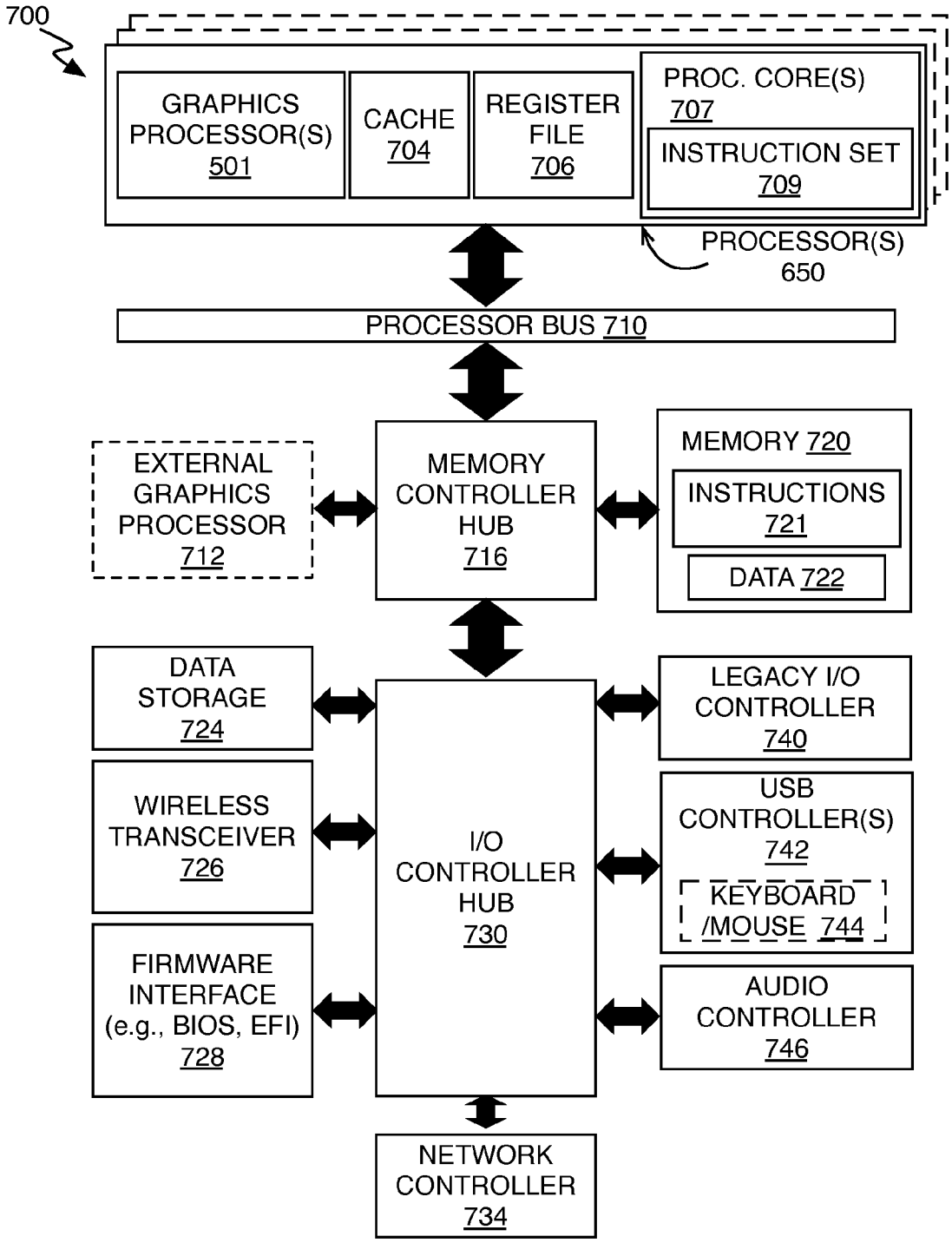
FIG. 7 is a block diagram of a data processing system, in accordance with some embodiments.

FIG. 7 block diagrams a data processing system 700 that may be utilized to generate and encode frames to convey PSR-IQ data. Data processing system 700 includes one or more processors 702 and one or more graphics processors 708, and may be implemented in a single processor desktop system, a multiprocessor workstation system, or a server system having a large number of processors 702 or processor cores 707. In another embodiment, the data processing system 700 is a system-on-a-chip (SoC) integrated circuit for use in mobile, handheld, or embedded devices.

An embodiment of data processing system 700 can include, or be incorporated within a server-based gaming platform, a game console, including a game and media console, a mobile gaming console, a handheld game console, or an online game console. In some embodiments, data processing system 700 is a mobile phone, smart phone, tablet computing device or mobile Internet device. Data processing system 700 can also include, couple with, or be integrated within a wearable device, such as a smart watch wearable device, smart eyewear device, augmented reality device, or virtual reality device. In some embodiments, data processing system 700 is a television or set top box device having one or more processors 702 and a graphical interface generated by one or more graphics processors 708.

In some embodiments, the one or more processors 702 each include one or more processor cores 707 to process instructions which, when executed, perform operations for system and user software. In some embodiments, each of the one or more processor cores 707 is configured to process a specific instruction set 709. In some embodiments, instruction set 709 may facilitate Complex Instruction Set Computing (CISC), Reduced Instruction Set Computing (RISC), or computing via a Very Long Instruction Word (VLIW). Multiple processor cores 707 may each process a different instruction set 709, which may include instructions to facilitate the emulation of other instruction sets. Processor core 707 may also include other processing devices, such a Digital Signal Processor (DSP).

In some embodiments, the processor 702 includes cache memory 704. Depending on the architecture, the processor 702 can have a single internal cache or multiple levels of internal cache. In some embodiments, the cache memory is shared among various components of the processor 702. In some embodiments, the processor 702 also uses an external cache (e.g., a Level-3 (L3) cache or Last Level Cache (LLC)) (not shown), which may be shared among processor cores 707 using known cache coherency techniques. A register file 706 is additionally included in processor 702 which may include different types of registers for storing different types of data (e.g., integer registers, floating point registers, status registers, and an instruction pointer register). Some registers may be general-purpose registers, while other registers may be specific to the design of the processor 702.

In some embodiments, processor 702 is coupled to a processor bus 710 to transmit data signals between processor 702 and other components in system 700. System 700 has a 'hub' system architecture, including a memory controller hub 716 and an input output (I/O) controller hub 730. Memory controller hub 716 facilitates communication between a memory device and other components of system 700, while I/O Controller Hub (ICH) 730 provides connections to I/O devices via a local I/O bus.

Memory device 720 can be a dynamic random access memory (DRAM) device, a static random access memory (SRAM) device, flash memory device, or some other memory device having suitable performance to serve as process memory. Memory 720 can store data 722 and instructions 721 for use when processor 702 executes a process. Memory controller hub 716 also couples with an optional external graphics processor 712, which may communicate with the one or more graphics processors 708 in processors 702 to perform graphics and media operations.

In some embodiments, ICH 730 enables peripherals to connect to memory 720 and processor 702 via a high-speed I/O bus. The I/O peripherals include an audio controller 746, a firmware interface 728, a wireless transceiver 726 (e.g., Wi-Fi, Bluetooth), a data storage device 724 (e.g., hard disk drive, flash memory, etc.), and a legacy I/O controller for coupling legacy (e.g., Personal System 2 (PS/2)) devices to the system. One or more Universal Serial Bus (USB) controllers 742 connect input devices, such as keyboard and mouse 744 combinations. A network controller 734 may also couple to ICH 730. In some embodiments, a high-performance network controller (not shown) couples to processor bus 710.

Figure 8:
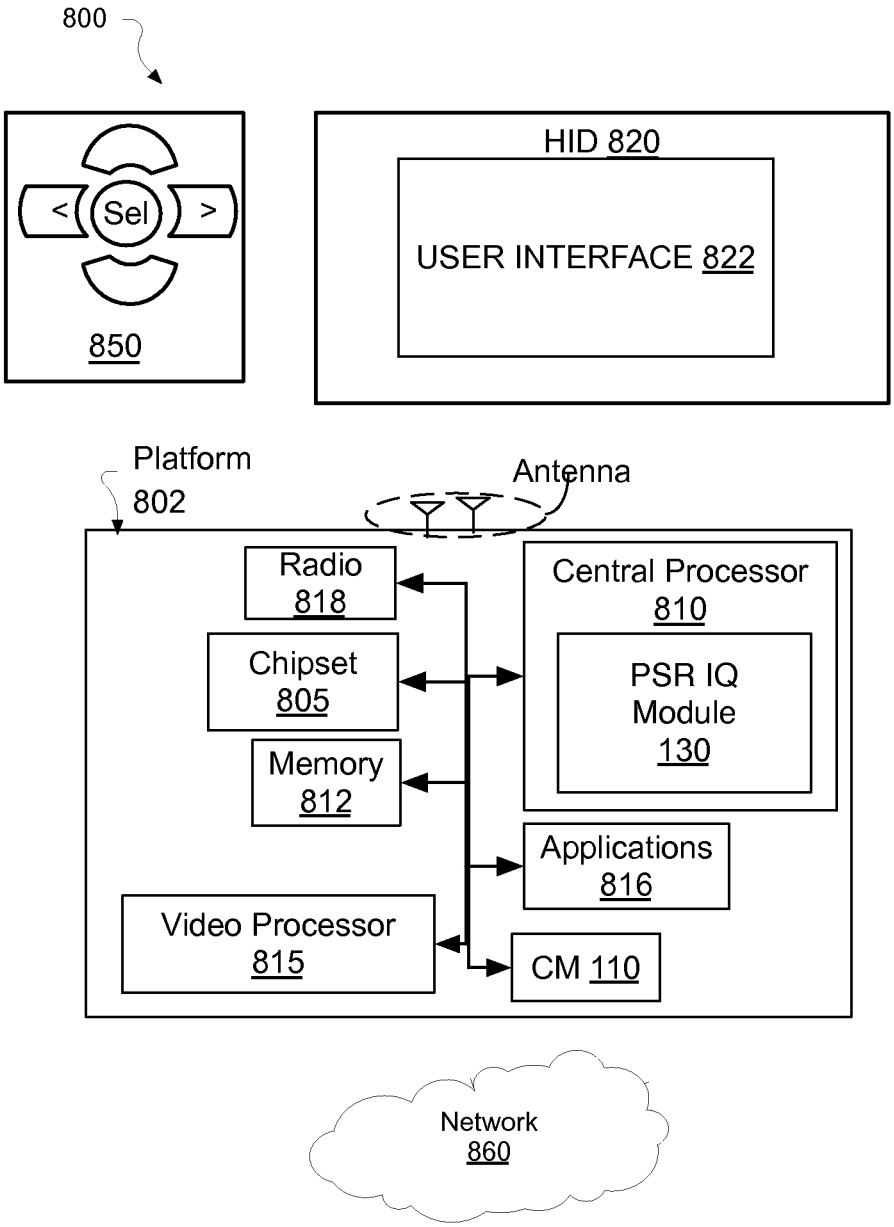
FIG. 8 is a diagram of an exemplary ultra-low power system including a PSR-IQ module, in accordance with some embodiments.

FIG. 8 is a diagram of an exemplary ultra-low power system 800, in accordance with one or more embodiment. System 800 may be a mobile device although system 800 is not limited to this context. System 800 may be incorporated into a wearable computing device, laptop computer, tablet, touch pad, handheld computer, palmtop computer, cellular telephone, smart device (e.g., smart phone, smart tablet or mobile television), mobile internet device (MID), messaging device, data communication device, and so forth. System 800 may also be an infrastructure device. For example, system 800 may be incorporated into a large format television, set-top box, desktop computer, or other home or commercial network device.

System 800 includes a device platform 802 that may implement all or a subset of the frame encoding, packetization, and wireless transmission methods described above in the context of FIG. 1-6. In various exemplary embodiments, central processor 810 executes PSR-IQ data flow control and MTS multiplexing, for example as described elsewhere herein. Processor 801 includes logic circuitry implementing PSR-IQ module 130, for example as described elsewhere herein. In some embodiments, one or more computer readable media may store instructions, which when executed by CPU 810 and/or video processor 815, cause the processor(s) to execute one or more of the image data generation, encoding and/or PSR-IQ data frame transmissions described elsewhere herein. One or more image data frames output by video processor 815 may then be transmitted by radio 818.

In embodiments, device platform 802 is coupled to a human interface device (HID) 820. Platform 802 may collect raw image data with CM 110, which is processed and output to HID 820. A navigation controller 850 including one or more navigation features may be used to interact with, for example, device platform 802 and/or HID 820. In embodiments, HID 820 may include any monitor or display coupled to platform 802 via radio 818 and/or network 860. HID 820 may include, for example, a computer display screen, touch screen display, video monitor, television-like device, and/or a television.

In embodiments, device platform 802 may include any combination of CM 110, chipset 805, processors 810, 815, memory/storage 812, applications 816, and/or radio 818. Chipset 805 may provide intercommunication among processors 810, 815, memory 812, video processor 815, applications 816, or radio 818.

One or more of processors 810, 815 may be implemented as one or more Complex Instruction Set Computer (CISC) or Reduced Instruction Set Computer (RISC) processors; x86 instruction set compatible processors, multi-core, or any other microprocessor or central processing unit (CPU).

Memory 812 may be implemented as a volatile memory device such as, but not limited to, a Random Access Memory (RAM), Dynamic Random Access Memory (DRAM), or Static RAM (SRAM). Memory 812 may also be implemented as a non-volatile storage device such as, but not limited to flash memory, battery backed-up SDRAM (synchronous DRAM), magnetic memory, phase change memory, and the like.

Radio 818 may include one or more radios capable of transmitting and receiving signals using various suitable wireless communications techniques. Such techniques may involve communications across one or more wireless networks. Example wireless networks include (but are not limited to) wireless local area networks (WLANs), wireless personal area networks (WPANs), wireless metropolitan area network (WMANs), cellular networks, and satellite networks. In communicating across such networks, radio 618 may operate in accordance with one or more applicable standards in any version.

In embodiments, system 800 may be implemented as a wireless system, a wired system, or a combination of both. When implemented as a wireless system, system 800 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the RF spectrum and so forth. When implemented as a wired system, system 800 may include components and interfaces suitable for communicating over wired communications media, such as input/output (I/O) adapters, physical connectors to connect the I/O adapter with a corresponding wired communications medium, a network interface card (NIC), disc controller, video controller, audio controller, and the like. Examples of wired communications media may include a wire, cable, metal leads, printed circuit board (PCB), backplane, switch fabric, semiconductor material, twisted-pair wire, co-axial cable, fiber optics, and so forth.

Figure 9:
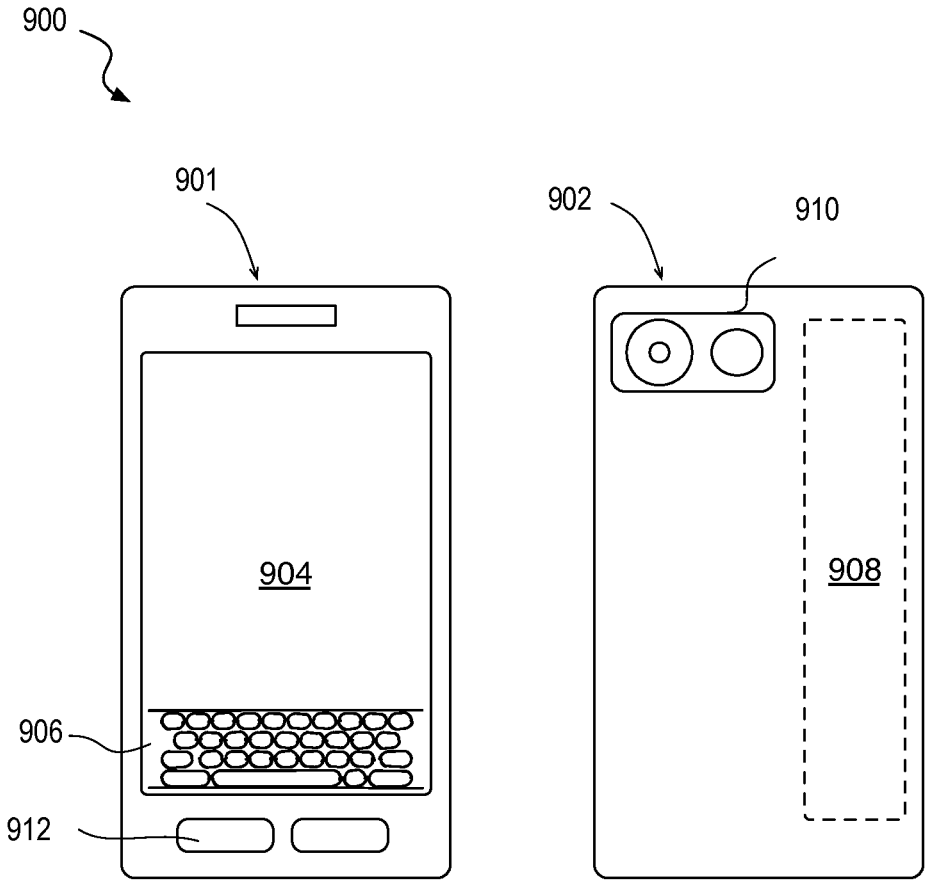
FIG. 9 is a diagram of an exemplary mobile handset platform, arranged in accordance with some embodiments.

As described above, system 800 may be embodied in varying physical styles or form factors. FIG. 9 further illustrates embodiments of a mobile handset device 900 in which platform 802 and/or system 800 may be embodied. In embodiments, for example, device 900 may be implemented as a mobile computing handset device having wireless capabilities. As shown in FIG. 9, mobile handset device 900 may include a housing with a front 901 and back 902. Device 900 includes a display 904, an input/output (I/O) device 906, and an integrated antenna 908. Device 900 also may include navigation features 912. Display 904 may include any suitable display unit for displaying information appropriate for a mobile computing device. I/O device 906 may include any suitable I/O device for entering information into a mobile computing device. Examples for I/O device 906 may include an alphanumeric keyboard, a numeric keypad, a touch pad, input keys, buttons, switches, microphones, speakers, voice recognition device and software, and so forth. Information also may be entered into device 900 by way of microphone (not shown), or may be digitized by a voice recognition device. Embodiments are not limited in this context. Integrated into at least the front 901, and/or back 902, is a camera module 910 (e.g., including one or more lens, aperture, and imaging sensor).

As exemplified above, embodiments described herein may be implemented using hardware elements, software elements, or a combination of both. Examples of hardware elements or modules include: processors, microprocessors, circuitry, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software elements or modules include: applications, computer programs, application programs, system programs, machine programs, operating system software, middleware, firmware, routines, subroutines, functions, methods, procedures, software interfaces, application programming interfaces (API), instruction sets, computing code, computer code, code segments, computer code segments, data words, values, symbols, or any combination thereof. Determining whether an embodiment is implemented using hardware elements and/or software elements may vary in accordance with any number of factors considered for the choice of design, such as, but not limited to: desired computational rate, power levels, heat tolerances, processing cycle budget, input data rates, output data rates, memory resources, data bus speeds and other design or performance constraints.

The wireless display static frame quality improvements and PSR-IQ data transmission methods comporting with exemplary embodiments described herein may be implemented in various hardware architectures, cell designs, or "IP cores."

One or more aspects of at least one embodiment may be implemented by representative instructions stored on a machine-readable storage medium. Such instructions may reside, completely or at least partially, within a main memory and/or within a processor during execution thereof by the machine, the main memory and the processor portions storing the instructions then also constituting a machine-readable storage media. Programmable logic circuitry may have registers, state machines, etc. configured by the processor implementing the computer readable media. Such logic circuitry, as programmed, may then be understood as physically transformed into a system falling within the scope of at least some embodiments described herein. Instructions representing various logic within the processor, which when read by a machine may also cause the machine to fabricate logic adhering to the architectures described herein and/or to perform the techniques described herein. Such representations, known as cell designs, or IP cores, may be stored on a tangible, machine-readable medium and supplied to various customers or manufacturing facilities to load into the fabrication machines that actually make the logic or processor.

While certain features set forth herein have been described with reference to embodiments, this description is not intended to be construed in a limiting sense. Hence, various modifications of the implementations described herein, as well as other implementations, which are apparent to persons skilled in the art to which the present disclosure pertains are deemed to be within the spirit and scope of the present disclosure.

The following paragraphs briefly describe some exemplary embodiments:

In one or more first embodiments, an image frame display source apparatus, comprises an image frame processing pipeline to generate an image frame for display, a transmitter coupled downstream of the image frame processing pipeline to stream an encoded first representation of the first image frame to a display device, and a static image quality improvement module to initiate streaming of additional data encoding the image frame in the event a second image frame is not generated within a predetermined time.

In furtherance of the first embodiments, the additional data encodes information for a second representation of the image frame having higher quality than that of the first encoded representation.

In furtherance of the embodiments immediately above, the apparatus further comprises a display buffer coupled to an output of the frame processing pipeline, the display buffer to store the image frame during a panel self-refresh (PSR) mode, and the additional data encodes high frequency components present in the image frame but absent from the first encoded representation.

In furtherance of the embodiments immediately above, the apparatus further comprises a source display panel to statically refresh the first image frame during the PSR mode, and an image frame encoder coupled to the quality improvement module and the display buffer, the image frame encoder to encode a residual between the image frame stored in the display buffer and the first encoded representation.

In furtherance of the first embodiments, the first encoded representation comprises a first I-frame or P-frame, and the additional data comprises a second P-frame.

In furtherance of the embodiments immediately above, the second P-frame encodes high frequency components present in the image frame but absent from the first encoded representation, the additional data further comprises a third P-frame transmitted subsequent to the second P-frame, the third P-frame encodes high frequency components present in the image frame but absent from the second encoded representation.

In furtherance of the first embodiments, wherein the image frame processing pipeline is to generate a second image frame, and the quality improvement module is to terminate streaming of the additional data in response to the output of the second image frame.

In furtherance of the first embodiments, wherein the quality improvement module is to force the second image frame to be encoded as an I-frame or scene change frame regardless of a position of the image frame within a group of pictures (GOP).

In furtherance of the first embodiments, the additional data comprises a re-encoding of the first image frame.

In furtherance of the first embodiments, wherein the first encoded representation comprises a base layer of a scalable video coding (SVC) stream, and the additional data comprises one or more enhancement layer for the SVC stream.

In one or more second embodiments, a wireless display system, comprises the source apparatus of any one of the first embodiments to stream through a wireless transmission protocol, and a sink apparatus to present the first representation of the image frame on a sink display panel, to decode the additional data, and to present on the sink display panel a second representation of the image frame based on at least the additional data.

In furtherance of the second embodiments, the sink display panel is to self-refresh the second representation of the image frame until a second image frame is received from the source apparatus.

In one or more third embodiments, a method for improving the quality of a static image presented on a sink display comprises generating an image frame for display, streaming an encoded first representation of the first image frame to a display device, and streaming additional data encoding the image frame in the event a second image frame is not generated within a predetermined time.

In furtherance of the third embodiments, the method further comprises storing the image frame during a panel self-refresh (PSR) mode, and the additional data encodes high frequency components present in the image frame but absent from the first encoded representation.

In furtherance of the third embodiments immediately above, the method further comprises statically refreshing the first image frame during the PSR mode, and encoding a residual between the image frame stored in the display buffer and the first encoded representation.

In furtherance of the third embodiments immediately above, the first encoded representation comprises a first I-frame or P-frame, and the additional data comprises a second P-frame encoding high frequency components present in the image frame but absent from the first encoded representation, and the method further comprises transmitting a third P-frame subsequent to the second P-frame, the third P-frame encoding high frequency components present in the image frame but absent from the second encoded representation In furtherance of the third embodiments, the method further comprises encoding the first encoded representation into at least a base layer of a Scalable Video Coding (SVC) stream, and encoding the additional data into one or more enhancement layer of the SVC stream.

In one or more fourth embodiment, one or more computer readable media includes instruction stored thereon, which when executed by a processing system, cause the system to perform any one of the third embodiments.

In one or more fifth embodiments, an apparatus comprises means to perform any one of the third embodiments.

In one or more sixth embodiments, one or more computer readable media includes instruction stored thereon, which when executed by a processing system, cause the system to perform a method comprising generating an image frame for display, streaming an encoded first representation of the first image frame to a display device, and streaming additional data encoding the image frame in the event a second image frame is not generated within a predetermined time.

In furtherance of the sixth embodiments, the media further includes instructions stored thereon, which when executed by the processing system, cause the system to perform a method comprising storing the image frame during a panel self-refresh (PSR) mode, statically refreshing the first image frame during the PSR mode, and encoding a residual between the image frame stored in the display buffer and the first encoded representation, wherein the residual comprises high frequency components present in the image frame but absent from the first encoded representation.

It will be recognized that the embodiments are not limited to the exemplary embodiments so described, but can be practiced with modification and alteration without departing from the scope of the appended claims. For example, the above embodiments may include specific combination of features. However, the above embodiments are not limited in this regard and, in embodiments, the above embodiments may include undertaking only a subset of such features, undertaking a different order of such features, undertaking a different combination of such features, and/or undertaking additional features than those features explicitly listed. Scope should, therefore, be determined with reference to the appended claims, along with the full scope of equivalents to which such claims are entitled.

What is claimed is:

1. An image frame display source apparatus, comprising:

one or more processors to generate image frames for display;

a transmitter to stream an encoded first representation of a first of the image frames to a display device;

a display buffer to store the first image frame during a panel self-refresh (PSR) mode;

a source display panel to statically refresh the first image frame during the PSR mode;

an image frame encoder to encode a residual between the first image frame stored in the display buffer and the first encoded representation, wherein the residual includes high frequency components present in the first image frame but absent from the first encoded representation; and wherein the processors are to cause the transmitter to initiate streaming of additional data encoding information for a second representation of the first image frame having higher quality than that of the first encoded representation in the event a second of the image frames is not generated within a predetermined time, wherein the additional data comprises the encoded residual.

2. The apparatus of claim 1, wherein the first encoded representation comprises a first I-frame or P-frame, and the additional data comprises a second P-frame.

3. The apparatus of claim 2, wherein:

the second P-frame encodes the high frequency components;

the additional data further comprises a third P-frame transmitted subsequent to the second P-frame; and the third P-frame encodes high frequency components present in the first image frame but absent from the second encoded representation.

4. The apparatus of claim 1, wherein:

the processors are to generate the second image frame; and the processors are to terminate streaming of the additional data in response to the generation of the second image frame.

5. The apparatus of claim 4, wherein the processors are to cause the second image frame to be encoded as an I-frame or scene change frame regardless of a position of the image frame within a group of pictures (GOP).

6. The apparatus of claim 1, wherein the additional data comprises a re-encoding of the first image frame.

7. The apparatus of claim 1, wherein:

the first encoded representation comprises a base layer of a scalable video coding (SVC) stream; and the additional data comprises one or more enhancement layer for the SVC stream.

8. A wireless display system, comprising:

the source apparatus of claim 1 to stream through a wireless transmission protocol; and a sink apparatus to:

present the first representation of the first image frame on a sink display panel;

decode the additional data; and present on the sink display panel the second representation of the first image frame based on at least the additional data.

9. The display system of claim 8, wherein the sink display panel is to self-refresh the second representation of the first image frame until the second image frame is received from the source apparatus.

10. A method for improving the quality of a static image presented on a sink display, the method comprising:

generating an image frame for display;

streaming an encoded first representation of the image frame to a display device;

storing the image frame in a display buffer during a panel self-refresh (PSR) mode;

refreshing the image frame during the PSR mode;

encoding a residual between the image frame stored in the display buffer and the first encoded representation, wherein the residual includes high frequency components present in the first image frame but absent from the first encoded representation; and streaming additional data encoding the image frame in the event a second image frame is not generated within a predetermined time, wherein the additional data encodes information for a second representation of the first image frame having higher quality than that of the first encoded representation, and wherein the additional data comprises the encoded residual.

11. The method of claim 10, wherein:

the first encoded representation comprises a first I-frame or P-frame, and the additional data comprises a second P-frame encoding high frequency components present in the image frame but absent from the first encoded representation; and wherein the method further comprises transmitting a third P-frame subsequent to the second P-frame, the third P-frame encoding high frequency components present in the image frame but absent from the second encoded representation.

12. The method of claim 10, further comprising:

encoding the first encoded representation into at least a base layer of a scalable video coding (SVC) stream; and encoding the additional data into one or more enhancement layer of the SVC stream.

13. One or more non-transitory computer readable media including instruction stored thereon, which when executed by a processing system, cause one or more processors of the system to perform a method comprising:

generating an image frame for display;

streaming an encoded first representation of the image frame to a display device;

storing the image frame in a display buffer during a panel self-refresh (PSR) mode;

refreshing the image frame during the PSR mode;

encoding a residual between the image frame stored in the display buffer and the first encoded representation, wherein the residual includes high frequency components present in the first image frame but absent from the first encoded representation; and streaming additional data encoding the image frame in the event a second image frame is not generated within a predetermined time, wherein the additional data encodes information for a second representation of the first image frame having higher quality than that of the first encoded representation, and wherein the additional data comprises the encoded residual.

14. The media of claim 13, wherein:

the first encoded representation comprises a first I-frame or P-frame, and the additional data comprises a second P-frame encoding high frequency components present in the image frame but absent from the first encoded representation; and the media further comprises instructions to cause the system to transmit a third P-frame subsequent to the second P-frame, the third P-frame encoding high frequency components present in the image frame but absent from the second encoded representation.

* * * * *